US011274871B2

(12) United States Patent
Sakae et al.

(10) Patent No.: US 11,274,871 B2
(45) Date of Patent: Mar. 15, 2022

(54) REFRIGERATION APPARATUS

(71) Applicant: DAIKIN INDUSTRIES, LTD., Osaka (JP)

(72) Inventors: Satoru Sakae, Osaka (JP); Azuma Kondou, Osaka (JP); Masaaki Takegami, Osaka (JP); Kazuyoshi Nomura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 199 days.

(21) Appl. No.: 16/330,022

(22) PCT Filed: Aug. 30, 2017

(86) PCT No.: PCT/JP2017/031182
§ 371 (c)(1),
(2) Date: Mar. 1, 2019

(87) PCT Pub. No.: WO2018/043571
PCT Pub. Date: Mar. 8, 2018

(65) Prior Publication Data

US 2019/0195550 A1 Jun. 27, 2019

(30) Foreign Application Priority Data

Sep. 2, 2016 (JP) ..... JP2016-172009

(51) Int. Cl.
*F25B 47/02* (2006.01)
*F25D 21/00* (2006.01)
(Continued)

(52) U.S. Cl.
CPC ..... *F25D 21/006* (2013.01); *F25B 1/00* (2013.01); *F25B 47/02* (2013.01); *F25B 47/025* (2013.01);
(Continued)

(58) Field of Classification Search
CPC .... F25D 21/006; F25D 17/062; F25D 21/008; F25D 2700/12; F25D 2700/00; F25D 21/14; F25B 47/025; F25B 2347/02
See application file for complete search history.

(56) References Cited

U.S. PATENT DOCUMENTS

2011/0296861 A1* 12/2011 Honda ..... F24D 3/08 62/238.7
2015/0233622 A1* 8/2015 Yajima ..... F25B 49/005 62/129
2017/0307268 A1* 10/2017 Shimazu ..... F16K 47/04

FOREIGN PATENT DOCUMENTS

CN 101196357 A 6/2008
CN 102226550 A 10/2011
(Continued)

OTHER PUBLICATIONS

US 5,894,779 A, 04/1999, Matsushima et al. (withdrawn)
(Continued)

*Primary Examiner* — Elizabeth J Martin
*Assistant Examiner* — Nael N Babaa
(74) *Attorney, Agent, or Firm* — Birch, Stewart, Kolasch & Birch, LLP

(57) ABSTRACT

Provided is a refrigeration apparatus capable of reducing the leakage of a refrigerant even when a refrigerant leak occurs in a defrosting operation of a usage-side heat exchanger. When a refrigerant leak situation around a usage-side heat exchanger satisfies a predetermined leak condition in performing a defrosting operation with a connection state of a four-way switching valve brought into a defrosting connection state in which a heat source-side heat exchanger functions as an evaporator for a refrigerant and a usage-side heat exchanger functions as a radiator for the refrigerant, a controller performs density lowering control to lower a refrigerant density in the usage-side heat exchanger while
(Continued)

maintaining the four-way switching valve at the defrosting connection state.

16 Claims, 6 Drawing Sheets

(51) Int. Cl.

| | |
|---|---|
| ***F25B 1/00*** | (2006.01) |
| ***F25B 49/02*** | (2006.01) |
| ***F25D 21/06*** | (2006.01) |
| ***F25D 17/06*** | (2006.01) |
| ***F25D 21/14*** | (2006.01) |

(52) U.S. Cl.
CPC ..... *F25B 49/02* (2013.01); *F25D 17/062* (2013.01); *F25D 21/008* (2013.01); *F25D 21/06* (2013.01); *F25D 21/14* (2013.01); *F25B 2347/02* (2013.01); *F25B 2700/00* (2013.01); *F25D 2700/12* (2013.01)

(56) References Cited

FOREIGN PATENT DOCUMENTS

| | | | | |
|---|---|---|---|---|
| EP | 2990737 | | 3/2016 | |
| JP | 9-42817 | A | 2/1997 | |
| JP | 2001-116419 | A | 4/2001 | |
| JP | 2002-277144 | A | 9/2002 | |
| JP | 3626890 | B2 * | 3/2005 | |
| JP | 2015-094573 | A | 5/2015 | |
| JP | WO2015046066 | A1 * | 3/2017 | ..... F25B 49/02 |
| WO | WO 2014/034099 | A1 | 3/2014 | |

OTHER PUBLICATIONS

Koichi, Refrigerator, 1999, Full Document (Year: 1999).*
FOR1, Refrigeration cycle equipment, 2014, Full Document (Year: 2014).*
International Search Report for PCT/JP2017/031182 (PCT/ISA/210) dated Oct. 24, 2017.

* cited by examiner

REFRIGERATION APPARATUS

TECHNICAL FIELD

The present invention relates to a refrigeration apparatus.

BACKGROUND ART

In a refrigeration cycle using a refrigerant circuit including a compressor, a heat source-side heat exchanger, an expansion valve, and a usage-side heat exchanger that are interconnected, heretofore, a refrigerant leak has sometimes occurred at the usage-side heat exchanger and its vicinity for any reason.

In this respect, for example, Patent Literature 1 (JP 2015-94573 A) discloses a technique of, upon detection of a refrigerant leak, operating a compressor with a valve downstream of a heat source-side heat exchanger closed, and recovering into the heat source-side heat exchanger a refrigerant in a refrigerant circuit, thereby suppressing the refrigerant leak into a space where a usage-side heat exchanger is placed, as much as possible.

SUMMARY OF THE INVENTION

Technical Problem

If frost forms on the usage-side heat exchanger that functions as an evaporator for the refrigerant, it has been considered to perform a defrosting operation of, in order to melt the frost, switching a connection state of the refrigerant circuit, supplying to the usage-side heat exchanger the high-temperature refrigerant discharged from the compressor, and causing the usage-side heat exchanger to function as a radiator for the refrigerant.

In the defrosting operation, the refrigerant discharged from the compressor is continuously supplied to the usage-side heat exchanger, and is condensed by heat exchange for defrosting, which results in an increase of the amount of the refrigerant in the usage-side heat exchanger. Accordingly, if the refrigerant leak occurs at the usage-side heat exchanger and its vicinity in the defrosting operation, the leakage of the refrigerant may increase. This may cause an increase in concentration of the refrigerant in the space where the usage-side heat exchanger is placed.

In view of the aspects described above, the present invention provides a refrigeration apparatus capable of reducing the leakage of a refrigerant even when a refrigerant leak occurs in a defrosting operation of a usage-side heat exchanger.

Solutions to Problem

According to a first aspect, a refrigeration apparatus includes a refrigerant circuit and a controller. The refrigerant circuit includes: a compressor, a heat source-side heat exchanger, and a heat source-side expansion valve of a heat source unit; and a usage-side heat exchanger and a switching valve of a usage unit. The switching valve is capable of switching a connection state of the refrigerant circuit between a normal connection state and a defrosting connection state. In the normal connection state, the heat source-side heat exchanger functions as a radiator for a refrigerant, and the usage-side heat exchanger functions as an evaporator for the refrigerant. In the defrosting connection state, the heat source-side heat exchanger functions as an evaporator for the refrigerant, and the usage-side heat exchanger functions as a radiator for the refrigerant. The controller is configured to switch the connection state of the switching valve to the defrosting connection state and to perform a defrosting operation when a predetermined defrosting condition is satisfied in the normal connection state of the switching valve. The controller performs density lowering control to lower a refrigerant density in the usage-side heat exchanger while maintaining the switching valve at the defrosting connection state when a refrigerant leak situation around the usage-side heat exchanger satisfies a predetermined leak condition in the defrosting operation.

Examples of the case where the refrigerant leak situation satisfies the predetermined leak condition may include, but not limited to, a case where a sensor detects that a leakage refrigerant concentration around the usage-side heat exchanger is equal to or more than a predetermined concentration, and a case where a sensor detects a change or reduction in value of a pressure or temperature of a refrigerant flowing through the usage-side heat exchanger or a pipe connected to the usage-side heat exchanger.

The refrigeration apparatus performs the density lowering control to lower the refrigerant density in the usage-side heat exchanger while maintaining the switching valve at the defrosting connection state when the refrigerant leak situation around the usage-side heat exchanger satisfies the predetermined leak condition in the defrosting operation. The refrigeration apparatus performs the density lowering control without changing the connection state of the switching valve, and therefore reduces the amount of the leakage of the refrigerant with ease.

According to a second aspect, in the refrigeration apparatus according to the first aspect, when the refrigerant leak situation around the usage-side heat exchanger satisfies the predetermined leak condition in the defrosting operation, the controller performs the density lowering control by raising a temperature of the refrigerant discharged from the compressor while maintaining the switching valve at the defrosting connection state.

The refrigeration apparatus puts the state of the refrigerant supplied to the usage-side heat exchanger into the superheated gas state, by raising the temperature of the refrigerant discharged from the compressor. The refrigeration apparatus thus lowers the refrigerant density.

According to a third aspect, in the refrigeration apparatus according to the second aspect, when the refrigerant leak situation around the usage-side heat exchanger satisfies the predetermined leak condition in the defrosting operation, the controller raises the temperature of the refrigerant discharged from the compressor, by lowering a valve opening degree of the heat source-side expansion valve below a valve opening degree immediately before the refrigerant leak situation satisfies the predetermined leak condition, while maintaining the switching valve at the defrosting connection state.

The refrigeration apparatus lowers the density of the refrigerant supplied to the usage-side heat exchanger, by a simple operation of lowering the valve opening degree of the heat source-side expansion valve below the valve opening degree immediately before the refrigerant leak situation satisfies the predetermined leak condition.

According to a fourth aspect, the refrigeration apparatus according to any of the first to third aspects further includes a usage-side fan. The usage-side fan is of the usage unit and is configured to provide an air flow for the usage-side heat exchanger. When the refrigerant leak situation around the usage-side heat exchanger satisfies the predetermined leak condition in the defrosting operation, the controller maintains or decreases an airflow volume of the usage-side fan at or below an airflow volume immediately before the refrigerant leak situation satisfies the predetermined leak condition, while maintaining the switching valve at the defrosting connection state.

The refrigeration apparatus maintains or decreases the airflow volume of the usage-side fan, and therefore does not increase the airflow volume of the usage-side fan. Hence, the refrigeration apparatus suppresses accelerated condensation of the refrigerant in the usage-side heat exchanger. The refrigeration apparatus thus lowers the refrigerant density in the usage-side heat exchanger with ease.

According to a fifth aspect, in the refrigeration apparatus according to any of the first to fourth aspects, when a predetermined termination condition for terminating the density lowering control is satisfied, the controller switches the connection state of the switching valve to the normal connection state, and then stops the compressor.

The refrigeration apparatus performs the density lowering control to lower the refrigerant density at the leak spot, and then switches the connection state of the switching valve from the defrosting connection state to the normal connection state when the refrigerant leak situation satisfies the predetermined leak condition. The refrigeration apparatus thus further reduces the amount of the leakage of the refrigerant around the usage-side heat exchanger, by connecting the usage-side heat exchanger, which has been connected to a discharge side of the compressor, to a suction side of the compressor.

According to a sixth aspect, the refrigeration apparatus according to any of the first to fifth aspects further includes a usage-side temperature sensor. The usage-side temperature sensor is configured to detect a temperature of the refrigerant flowing through the usage-side heat exchanger. The controller switches the connection state of the switching valve to the normal connection state after the termination of the density lowering control, and then stops the compressor. When the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

When the refrigerant leak situation does not satisfy the predetermined leak condition, the refrigeration apparatus continues the defrosting operation until the temperature detected by the usage-side temperature sensor satisfies the predetermined temperature condition. This configuration enables more satisfactory melting of frost on the usage-side heat exchanger. When the refrigerant leak situation satisfies the predetermined leak condition, the controller does not continue the defrosting operation up to a time when the temperature detected by the usage-side temperature sensor satisfies the predetermined temperature condition, but performs the density lowering control even the temperature does not satisfy the predetermined temperature condition. The refrigeration apparatus therefore performs satisfactory defrosting when the refrigerant leak situation does not satisfy the predetermined leak condition, and promptly switches to a state in which a refrigerant leak hardly occurs when the refrigerant leak situation satisfies the predetermined leak condition.

According to a seventh aspect, the refrigeration apparatus according to the sixth aspect further includes a usage-side expansion valve. The usage-side expansion valve is of the usage unit and is disposed in a liquid side of the usage-side heat exchanger. When the refrigerant leak situation satisfies the predetermined leak condition in the defrosting operation, the controller performs retightening of the usage-side expansion valve. When the refrigerant leak situation does not satisfy the predetermined leak condition in the defrosting operation, the controller does not perform retightening of the usage-side expansion valve.

In a typical expansion valve whose valve opening degree is adjustable, the valve may not be completely closed even in a fully closed state, and may be slightly opened as unintended in some instances. If the valve is slightly opened as unintended, a refrigerant leak is likely to last as unintended although almost no adverse effects are exerted in a normal operation.

In view of this, the refrigeration apparatus performs retightening of the usage-side expansion valve when the refrigerant leak situation satisfies the predetermined leak condition. The refrigeration apparatus therefore suppresses a state in which the refrigerant is continuously supplied to the usage-side heat exchanger via the usage-side expansion valve, even in a case where the controller performs the density lowering control when the refrigerant leak situation satisfies the predetermined leak condition in the defrosting operation, and then switches the connection state of the switching valve to the normal connection state and drives the compressor until a time to stop the compressor comes.

Advantageous Effects of Invention

The refrigeration apparatus according to the first aspect reduces the amount of the leakage of a refrigerant even when a refrigerant leak occurs in a defrosting operation of the usage-side heat exchanger.

The refrigeration apparatus according to the second aspect lowers a refrigerant density by putting the state of the refrigerant supplied to the usage-side heat exchanger into the superheated gas state.

The refrigeration apparatus according to the third aspect lowers the density of the refrigerant supplied to the usage-side heat exchanger, with a simple operation.

The refrigeration apparatus according to the fourth aspect easily lowers the refrigerant density in the usage-side heat exchanger.

The refrigeration apparatus according to the fifth aspect lowers a refrigerant density at a leak spot, and further reduces the amount of the leakage of the refrigerant by connecting the usage-side heat exchanger to the suction side of the compressor.

The refrigeration apparatus according to the sixth aspect performs satisfactory defrosting when the refrigerant leak situation does not satisfy the predetermined leak condition, and promptly switches to a state in which a refrigerant leak hardly occurs when the refrigerant leak situation satisfies the predetermined leak condition.

The refrigeration apparatus according to the seventh aspect suppresses a state in which the refrigerant is continuously supplied to the usage-side heat exchanger via the usage-side expansion valve, even in a case where the control unit performs the density lowering control, and then switches the connection state of the switching valve to the normal connection state and drives the compressor until a time to stop the compressor comes.

DESCRIPTION OF EMBODIMENTS

A refrigeration apparatus 100 according to an embodiment of the present invention will be described below with reference to the drawings. It should be noted that the following embodiments are merely specific examples of the present invention, do not intend to limit the technical scope of the present invention, and may be appropriately modified without departing from the gist of the present invention.

(1) Refrigeration Apparatus 100

Figure 1:
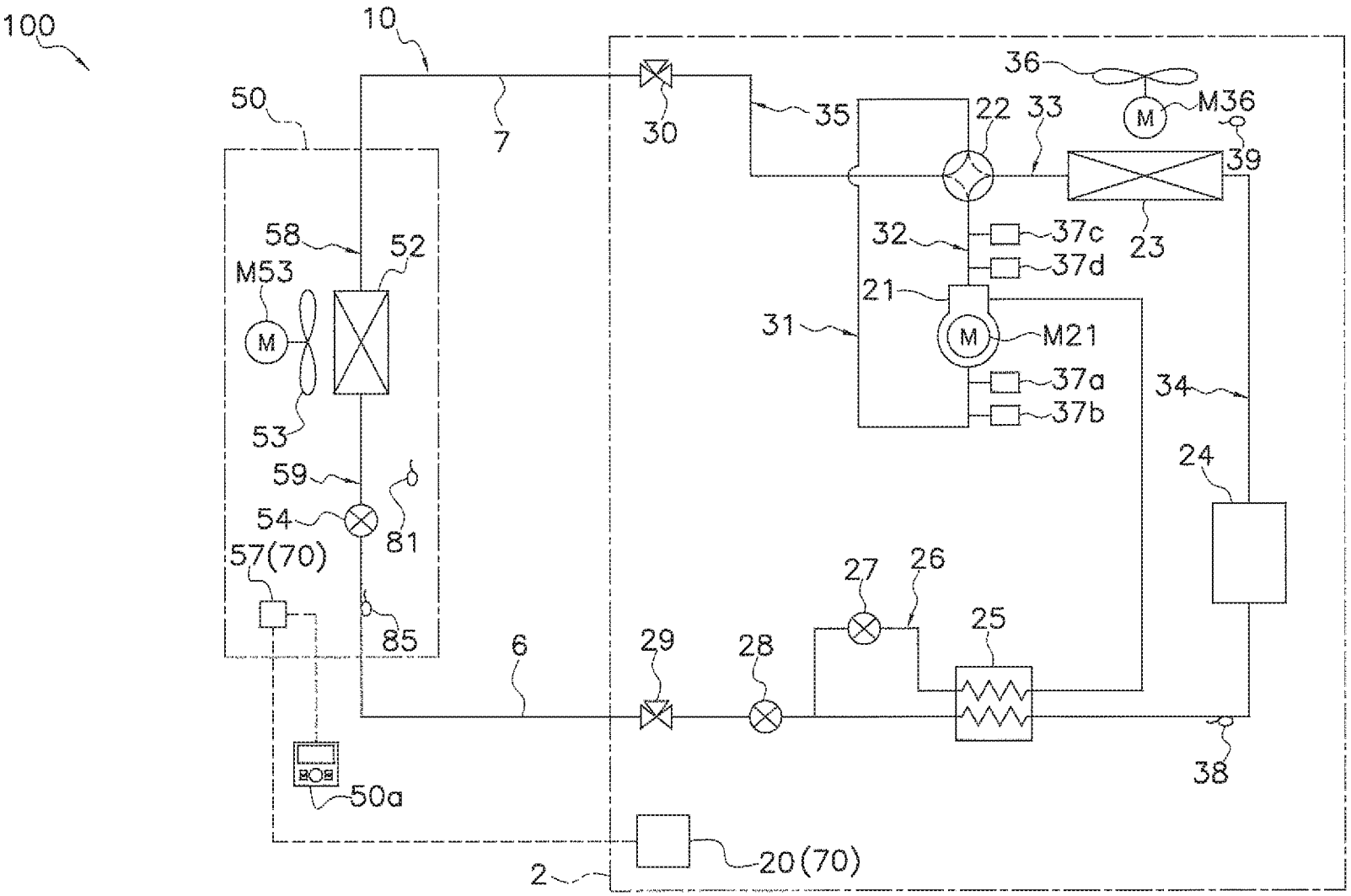
FIG. 1 is a general configuration diagram of a refrigeration apparatus according to an embodiment of the present invention.

FIG. 1 is a schematic configuration diagram of a refrigeration apparatus 100 according to an embodiment of the present invention. The refrigeration apparatus 100 employs a vapor compression refrigeration cycle to cool a usage-side space such as the interior of a cold storage warehouse or the interior of a showcase in a store.

The refrigeration apparatus 100 mainly includes: a heat source unit 2; a usage unit 50; a liquid-refrigerant connection pipe 6 and a gas-refrigerant connection pipe 7 each connecting the heat source unit 2 to the usage unit 50; a refrigerant leak sensor 81 configured to detect a refrigerant leak in the usage unit 50; a remote controller 50*a* serving as an input device and a display device; and a controller 70 configured to control operation of the refrigeration apparatus 100.

The refrigeration apparatus 100 performs a refrigeration cycle to compress, cool or condense, decompress, heat or evaporate, and then compress again a sealed-in refrigerant in a refrigerant circuit 10. In this embodiment, the refrigerant circuit 10 is filled with R32 as a refrigerant for a vapor compression refrigeration cycle.

(1-1) Heat Source Unit 2

The heat source unit 2 is connected to the usage unit 50 via the liquid-refrigerant connection pipe 6 and the gas-refrigerant connection pipe 7, and constitutes a part of the refrigerant circuit 10. The heat source unit 2 mainly includes a compressor 21, a four-way switching valve 22, a heat source-side heat exchanger 23, a heat source-side fan 36, a receiver 24, a subcooler 25, a heat source-side expansion valve 28, an injection pipe 26, an injection valve 27, a liquid-side shutoff valve 29, and a gas-side shutoff valve 30.

The heat source unit 2 also includes: a suction-side refrigerant pipe 31 connecting a suction side of the compressor 21 to a first connection port of the four-way switching valve 22; a discharge-side refrigerant pipe 32 connecting a discharge side of the compressor 21 to a third connection port of the four-way switching valve 22; a first heat source-side gas refrigerant pipe 33 connecting a second connection port of the four-way switching valve 22 to a gas-side end of the heat source-side heat exchanger 23; a heat source-side liquid refrigerant pipe 34 connecting a liquid-side end of the heat source-side heat exchanger 23 to the liquid-refrigerant connection pipe 6; and a second heat source-side gas refrigerant pipe 35 connecting the gas-refrigerant connection pipe 7 to a fourth connection port of the four-way switching valve 22.

The heat source unit 2 includes: the injection pipe 26 configured to shunt part of the refrigerant flowing through the heat source-side liquid refrigerant pipe 34 back to the compressor 21; and the injection valve 27 disposed at the middle of the injection pipe 26. The injection pipe 26 branches off the heat source-side liquid refrigerant pipe 34 at a portion downstream of the subcooler 25, passes through the subcooler 25, and is connected to the compressor 21 in an intermediate state of a compression process.

The compressor 21 is a device configured to change by compression a low-pressure refrigerant to a high-pressure refrigerant in the refrigeration cycle. The compressor 21 used herein is a closed compressor in which a displacement compression element, such as rotary or scroll, (not illustrated) is driven to rotate by a compressor motor M21. Although not illustrated in the drawings, the compressor 21 in this embodiment includes one or more constant-speed compressors and a variable displacement compressor that are connected in parallel. The variable displacement compressor includes the compressor motor M21 and has an operating frequency controllable by an inverter. In decreasing the capacity of the compressor 21, the operating frequency of the variable displacement compressor is lowered. In further decreasing the capacity of the variable displacement compressor even though the operating frequency of the variable displacement compressor has been lowered, the constant-speed compressors are stopped. However, the method of decreasing the capacity is not limited thereto.

The four-way switching valve 22 is configured to switch a connection state of the refrigerant circuit 10 between a normal connection state and a defrosting connection state. In the normal connection state, the four-way switching valve 22 connects the second connection port to the third connection port and also connects the first connection port to the fourth connection port (see a solid line in FIG. 1), thereby bringing the refrigerant circuit 10 into a state in which the heat source-side heat exchanger 23 is connected to the discharge side of the compressor 21 and the gas-refrigerant connection pipe 7 is connected to the suction side of the compressor 21 via the suction-side refrigerant pipe 31 and the second heat source-side gas refrigerant pipe 35. In the defrosting connection state, the four-way switching valve 22 connects the first connection port to the second connection port and also connects the third connection port to the fourth connection port (see a dotted line in FIG. 1), thereby bringing the refrigerant circuit 10 into a state in which the gas-refrigerant connection pipe 7 is connected to the discharge side of the compressor 21 via the second heat source-side gas refrigerant pipe 35 and the heat source-side heat exchanger 23 is connected to the suction side of the compressor 21 via the suction-side refrigerant pipe 31. When the four-way switching valve 22 is in the normal connection state, a cooling operation is performed, in which the heat source-side heat exchanger 23 functions as a radiator for the refrigerant and a usage-side heat exchanger 52 functions as an evaporator for the refrigerant. When the four-way switching valve 22 is in the defrosting connection state, a defrosting operation is performed, in which the usage-side heat exchanger 52 functions as a radiator for the refrigerant and the heat source-side heat exchanger 23 functions as an evaporator for the refrigerant.

The heat source-side heat exchanger 23 functions as the radiator for the refrigerant in the cooling operation, and also functions as the evaporator for the refrigerant in the defrosting operation. The heat source unit 2 includes the heat source-side fan 36 for sucking outside air (heat source-side air) into the heat source unit 2, causing the heat source-side air to exchange heat with the refrigerant in the heat source-side heat exchanger 23, and then discharging the heat source-side air. The heat source-side fan 36 is configured to supply to the heat source-side heat exchanger 23 the heat source-side air for cooling the refrigerant flowing through the heat source-side heat exchanger 23. The heat source-side fan 36 is driven to rotate by a heat source-side fan motor M36.

The receiver 24 temporarily stores therein a surplus refrigerant in the refrigerant circuit 10. The receiver 24 is disposed at the middle of the heat source-side liquid refrigerant pipe 34.

The subcooler 25 is a heat exchanger for further cooling the refrigerant temporarily stored in the receiver 24 in the cooling operation. The subcooler 25 is disposed in the heat source-side liquid refrigerant pipe 34. Specifically, the subcooler 25 is disposed closer to the liquid-refrigerant connection pipe 6 than the receiver 24 is.

The heat source-side expansion valve 28 is an electric expansion valve whose opening degree is controllable. The heat source-side expansion valve 28 is disposed in the heat source-side liquid refrigerant pipe 34. Specifically, the heat source-side expansion valve 28 is disposed closer to the liquid-refrigerant connection pipe 6 than the subcooler 25 is.

The injection valve 27 is disposed in the injection pipe 26. Specifically, the injection valve 27 is disposed between a branched portion of the heat source-side liquid refrigerant pipe 34 and an inlet of the subcooler 25. The injection valve 27 is an electric expansion valve whose opening degree is controllable. The injection valve 27 decompresses, in accordance with its opening degree, the refrigerant flowing through the injection pipe 26 before the refrigerant flows into the subcooler 25.

The liquid-side shutoff valve 29 is a manual valve disposed at a joint between the heat source-side liquid refrigerant pipe 34 and the liquid-refrigerant connection pipe 6.

The gas-side shutoff valve 30 is a manual valve disposed at a joint between the second heat source-side gas refrigerant pipe 35 and the gas-refrigerant connection pipe 7.

The heat source unit 2 includes various sensors. In the heat source unit 2, specifically, a suction pressure sensor 37*a*, a suction temperature sensor 37*b*, a discharge pressure sensor 37*c*, and a discharge temperature sensor 37*d* are disposed around the compressor 21. The suction pressure sensor 37*a* is configured to detect a suction pressure that is a pressure of the refrigerant at the suction side of the compressor 21. The suction temperature sensor 37*b* is configured to detect a suction temperature that is a temperature of the refrigerant at the suction side of the compressor 21. The discharge pressure sensor 37*c* is configured to detect a discharge pressure that is a pressure of the refrigerant at the discharge side of the compressor 21. The discharge temperature sensor 37*d* is configured to detect a discharge temperature that is a temperature of the refrigerant at the discharge side of the compressor 21. On the heat source-side liquid refrigerant pipe 34, a receiver outlet temperature sensor 38 is disposed between an outlet of the receiver 24 and the inlet of the subcooler 25. The receiver outlet temperature sensor 38 is configured to detect a receiver outlet temperature that is a temperature of the refrigerant at the outlet of the receiver 24. Moreover, a heat source-side air temperature sensor 39 is disposed around the heat source-side heat exchanger 23 or the heat source-side fan 36. The heat source-side air temperature sensor 39 is configured to detect a temperature of heat source-side air to be sucked into the heat source unit 2.

The heat source unit 2 also includes a heat source unit control unit 20 configured to control operations of the respective components constituting the heat source unit 2. The heat source unit control unit 20 includes a microcomputer including, for example, a central processing unit (CPU) and a memory. The heat source unit control unit 20 is connected to a usage unit control unit 57 of the usage unit 50 via a communication line to exchange, for example, a control signal with the usage unit control unit 57.

(1-2) Usage Unit 50

The usage unit 50 is connected to the heat source unit 2 via the liquid-refrigerant connection pipe 6 and the gas-refrigerant connection pipe 7, and constitutes a part of the refrigerant circuit 10.

The usage unit 50 includes a usage-side expansion valve 54 and a usage-side heat exchanger 52. The usage unit 50 also includes: a usage-side liquid refrigerant pipe 59 connecting a liquid-side end of the usage-side heat exchanger 52 to the liquid-refrigerant connection pipe 6; and a usage-side gas refrigerant pipe 58 connecting a gas-side end of the usage-side heat exchanger 52 to the gas-refrigerant connection pipe 7.

The usage-side expansion valve 54 is a restrictor disposed at the middle of the usage-side liquid refrigerant pipe 59 and functioning as means for decompressing the refrigerant passing therethrough. In this embodiment, the usage-side expansion valve 54 is an electric expansion valve whose opening degree is controllable. Specifically, the usage-side expansion valve 54 has a valve opening degree changeable under the pulse control by a pulse motor.

The usage-side heat exchanger 52 functions as an evaporator for the refrigerant to cool inside air (usage-side air) in the cooling operation, and also functions as a radiator for the refrigerant to melt frost on a surface of the usage-side heat exchanger 52 in the defrosting operation.

The usage unit 50 includes a usage-side fan 53 for sucking usage-side air into the usage unit 50, causing the usage-side air to exchange heat with the refrigerant in the usage-side heat exchanger 52, and then supplying the usage-side air to the usage-side space. The usage-side fan 53 is configured to supply to the usage-side heat exchanger 52 the usage-side air for heating the refrigerant flowing through the usage-side heat exchanger 52 in the cooling operation. The usage-side fan 53 is driven to rotate by a usage-side fan motor M53. The usage-side fan 53 is brought into a stopped state in the defrosting operation.

The usage unit 50 also includes a usage-side liquid pipe temperature sensor 85 configured to detect a temperature of the refrigerant flowing through a position opposite from the usage-side heat exchanger 52 with respect to the usage-side expansion valve 54 in the middle of the usage-side liquid refrigerant pipe 59.

The usage unit 50 also includes the usage unit control unit 57 configured to control operations of the respective components constituting the usage unit 50. Specifically, the usage unit control unit 57 controls the opening degree of the usage-side expansion valve 54, and the airflow volume of the usage-side fan 53. The usage unit control unit 57 includes a microcomputer including, for example, a CPU and a memory. The usage unit control unit 57 is connected to the heat source unit control unit 20 via the communication line to exchange, for example, a control signal with the heat source unit control unit 20. The usage unit control unit 57 is electrically connected to the refrigerant leak sensor 81 and the usage-side liquid pipe temperature sensor 85, thereby receiving signals from the refrigerant leak sensor 81 and the usage-side liquid pipe temperature sensor 85.

(1-3) Refrigerant Leak Sensor 81

The refrigerant leak sensor 81 is configured to detect a refrigerant leak in the usage unit 50. The refrigerant leak sensor 81 is disposed in a casing of the usage unit 50. The refrigerant leak sensor 81 to be used in this embodiment is a well-known general-purpose product.

Upon detection of a refrigerant leak, the refrigerant leak sensor 81 outputs an electric signal (hereinafter, referred to as a "refrigerant leak signal") indicative of occurrence of a refrigerant leak, to the usage unit control unit 57 connected thereto.

(1-4) Remote Controller 50*a*

The remote controller 50*a* is an input device that causes a user of the usage unit 50 to input various instructions for switching an operating state of the refrigeration apparatus 100. The remote controller 50*a* also functions as a display device for displaying the operating state of the refrigeration apparatus 100 and predetermined notification information. The remote controller 50*a* is connected to the usage unit control unit 57 via a communication line to exchange signals with the usage unit control unit 57.

(2) Details of Controller 70

In the refrigeration apparatus 100, the heat source unit control unit 20 and the usage unit control unit 57 are connected via the communication line to constitute the controller 70 for controlling operation of the refrigeration apparatus 100.

Figure 2:
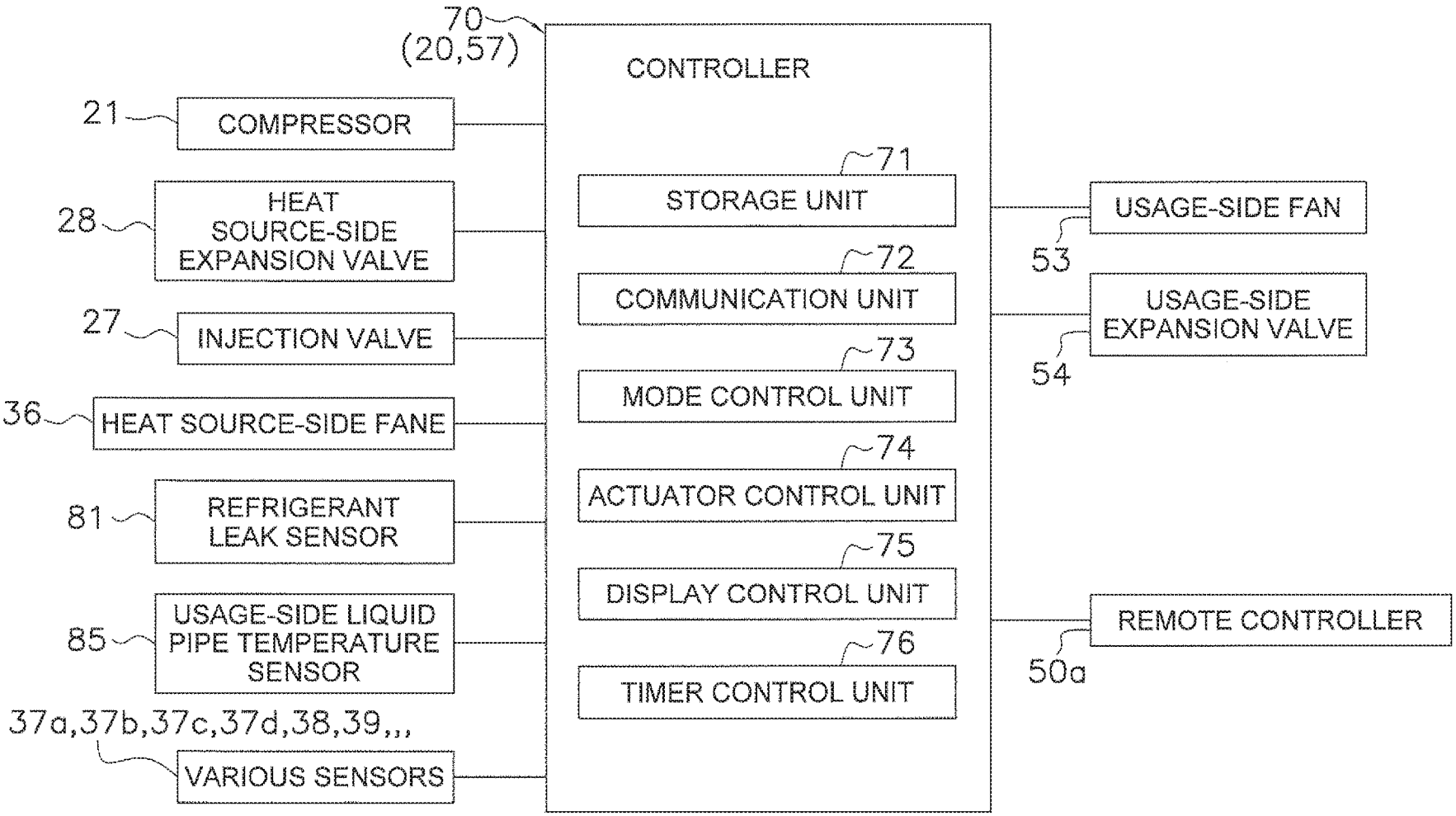
FIG. 2 is a schematic block diagram of a schematic configuration of a controller and components connected to the controller.

FIG. 2 is a schematic block diagram of a schematic configuration of the controller 70 and the components connected to the controller 70.

The controller 70 has a plurality of control modes, and controls the operation of the refrigeration apparatus 100 in accordance with a control mode in which the controller 70 is stated. Examples of the control modes of the controller 70 include: a normal operating mode in which the controller 70 is stated in a normal situation; a defrosting operating mode in which the controller 70 is stated in defrosting the usage-side heat exchanger 52; and a refrigerant leak control mode in which the controller 70 is stated upon occurrence of a refrigerant leak.

The controller 70 is electrically connected to the actuators (i.e., the compressor 21 (the compressor motor M21), the heat source-side expansion valve 28, the injection valve 27, and the heat source-side fan 36 (the heat source-side fan motor M36)) and the various sensors (i.e., the suction pressure sensor 37*a*, the suction temperature sensor 37*b*, the discharge pressure sensor 37*c*, the discharge temperature sensor 37*d*, the receiver outlet temperature sensor 38, the heat source-side air temperature sensor 39, and the like) in the heat source unit 2. The controller 70 is also electrically connected to the actuators (i.e., the usage-side fan 53 (the usage-side fan motor M53), the usage-side expansion valve 54) in the usage unit 50. The controller 70 is also electrically connected to the refrigerant leak sensor 81 and the remote controller 50*a*.

The controller 70 mainly includes a storage unit 71, a communication unit 72, a mode control unit 73, an actuator control unit 74, and a display control unit 75. These units in the controller 70 are implemented in such a manner that the components in the heat source unit control unit 20 and/or the usage unit control unit 57 integrally function.

(2-1) Storage Unit 71

The storage unit 71 includes, for example, a read only memory (ROM), a random access memory (RAM), and a flash memory. The storage unit 71 has a volatile storage region and a nonvolatile storage region. The storage unit 71 stores therein a control program that defines processing to be performed by each unit of the controller 70. Also in the storage unit 71, the respective units of the controller 70 appropriately store predetermined information (e.g., values detected by the respective sensors, commands input to the remote controller 50*a*) in a predetermined storage region.

(2-2) Communication Unit 72

The communication unit 72 is a functional unit that plays a role as a communication interface for exchanging signals with the respective components connected to the controller 70. The communication unit 72 receives a request from the actuator control unit 74, and transmits a predetermined signal to a designated one of the actuators. The communication unit 72 also receives signals from the various sensors (37*a*, 37*b*, 37*c*, 37*d*, 38, 39), the refrigerant leak sensor 81, and the remote controller 50*a*, and stores the received signals in the predetermined storage region of the storage unit 71.

(2-3) Mode Control Unit 73

The mode control unit 73 is a functional unit that switches a control mode, for example. In a state in which the refrigerant leak sensor 81 detects no refrigerant leak, the mode control unit 73 sets the control mode at the normal operating mode or the defrosting operating mode. The mode control unit 73 switches between the normal operating mode and the defrosting operating mode in accordance with a predetermined defrosting condition.

When the refrigerant leak sensor 81 detects a refrigerant leak, the mode control unit 73 sets the control mode at the refrigerant leak control mode.

(2-4) Actuator Control Unit 74

The actuator control unit 74 controls, on the basis of the control program, the operations of the respective actuators (e.g., the compressor 21) in the refrigeration apparatus 100, in accordance with a situation.

In the normal operating mode, for example, the actuator control unit 74 controls the number of rotations of the compressor 21, the valve opening degree of the usage-side expansion valve 54, the airflow volume of the heat source-side fan 36, the airflow volume of the usage-side fan 53, and the opening degree of the injection valve 27 in real time, in accordance with, for example, set temperatures and values detected by the various sensors, with the four-way switching valve 22 brought into the normal connection state. In the normal operating mode, the actuator control unit 74 brings the heat source-side expansion valve 28 into the fully open state. In the normal operating mode, the actuator control unit 74 sets a target value of a suction pressure in accordance with a cooling load to be required for the usage unit 50, and controls the operating frequency of the compressor 21 so as to acquire the suction pressure with the target value.

In the defrosting operating mode, the actuator control unit 74 controls, for example, the number of rotations of the compressor 21, the airflow volume of the heat source-side fan 36, and the valve opening degree of the heat source-side expansion valve 28, with the four-way switching valve 22 brought into the defrosting connection state. In the defrosting operating mode, for example, the actuator control unit 74 may control the number of rotations of the compressor 21 so as to maximize the number of rotations. Alternatively, the actuator control unit 74 may control the number of rotations of the compressor 21 so as to raise the pressure of the refrigerant discharged from the compressor 21 to a predetermined high pressure. However, the control by the actuator control unit 74 is not limited thereto. Also in the defrosting operating mode, the actuator control unit 74 may control the airflow volume of the heat source-side fan 36 so as to maximize the airflow volume. In this embodiment, in the defrosting operating mode, the actuator control unit 74 controls the valve opening degree of the heat source-side expansion valve 28 such that the suction refrigerant in the compressor 21 has a predetermined degree of superheating. In the defrosting operating mode, the actuator control unit 74 controls the usage-side expansion valve 54 so as to bring the usage-side expansion valve 54 into the fully open state, controls the usage-side fan 53 so as to bring the usage-side fan 53 into the stopped state, and controls the injection valve 27 so as to bring the injection valve 27 into a fully closed state.

In executing the refrigerant leak control mode on the basis of detection of a refrigerant leak by the refrigerant leak sensor 81 in the defrosting operating mode, the actuator control unit 74 performs density lowering control to lower the density of the refrigerant be supplied to the usage-side heat exchanger 52, during a predetermined leak initial time. In the density lowering control, the actuator control unit 74 lowers the valve opening degree of the heat source-side expansion valve 28 below the valve opening degree immediately before a start of the refrigerant leak control mode. Specifically, the actuator control unit 74 starts the density lowering control by lowering the valve opening degree of the heat source-side expansion valve 28 such that the temperature of the refrigerant discharged from the compressor 21 (i.e., the refrigerant temperature detected by the discharge temperature sensor 37*d*) takes a discharge temperature target value that is higher by a predetermined temperature than a discharge refrigerant temperature immediately before the start of the refrigerant leak control mode. The actuator control unit 74 controls the valve opening degree of the heat source-side expansion valve 28 such that the temperature of the refrigerant discharged from the compressor 21 takes the discharge temperature target value. However, the actuator control unit 74 controls the valve opening degree so as to maintain the valve opening degree at a state below the valve opening degree of the heat source-side expansion valve 28 immediately before the start of the refrigerant leak control mode. When the high-pressure refrigerant in the refrigerant circuit 10 (i.e., the refrigerant pressure detected by the discharge pressure sensor 37*c*) is more than a predetermined high-pressure threshold value after the start of the density lowering control, the actuator control unit 74 further decreases the number of rotations of the compressor 21. The target value in decreasing the number of rotations of the compressor 21 is not limited, and the actuator control unit 74 may decrease the number so as to have a pressure equal to or less than a predetermined reference pressure set in advance. In the density lowering control, preferably, the heat source-side expansion valve 28 is not brought into the fully closed state since the refrigerant from a leak spot at the usage unit 50 can be continuously recovered to the heat source unit 2.

After the density lowering control for the predetermined leak initial time, the actuator control unit 74 switches the connection state of the four-way switching valve 22 from the defrosting connection state to the normal connection state, and then performs a pump down operation to stop the compressor 21.

When the refrigerant leak sensor 81 detects a refrigerant leak in the normal operating mode, the actuator control unit 74 performs the pump down operation to stop the compressor 21 while maintaining the connection state of the four-way switching valve 22 at the normal connection state.

(2-5) Display Control Unit 75

The display control unit 75 is a functional unit that controls operation of the remote controller 50*a* serving as the display device.

The display control unit 75 causes the remote controller 50*a* to output predetermined information in order that an operating state or information on a situation is displayed for an administrator.

For example, the display control unit 75 causes the remote controller 50*a* to display thereon various kinds of information, such as set temperatures, during the cooling operation and the defrosting operation in the normal operating mode.

In the refrigerant leak control mode, the display control unit 75 causes the remote controller 50*a* to display thereon information indicative of occurrence of a refrigerant leak. Also in the refrigerant leak control mode, the display control unit 75 causes the remote controller 50*a* to display thereon information urging the user to make a notification to a service engineer.

(2-6) Timer Control Unit 76

A timer control unit 76 is a functional unit that measures an elapsed time for predetermined processing, for example. Specifically, the defrosting operation is started when the normal operating mode is continuously executed for a predetermined determination time. In this case, the timer control unit 76 measures the predetermined determination time, for example. In addition, the density lowering control is performed for the predetermined leak initial time in executing the refrigerant leak control mode on the basis of the detection of the refrigerant leak by the refrigerant leak sensor 81 in the defrosting operating mode. In this case, the timer control unit 76 also measures the predetermined leak initial time.

(3) Flow of Refrigerant in Normal Operating Mode

Next, a description will be given of the flow of the refrigerant in the refrigerant circuit 10 in the normal operating mode.

The normal operating mode is executed with the connection state of the four-way switching valve 22 switched to the normal connection state.

During the operation, the refrigeration apparatus 100 performs the cooling operation (a refrigeration cycle operation) causing the refrigerant in the refrigerant circuit 10 to mainly circulate through the compressor 21, the heat source-side heat exchanger 23, the receiver 24, the subcooler 25, the heat source-side expansion valve 28, the usage-side expansion valve 54, and the usage-side heat exchanger 52 in this order.

When the cooling operation is started, the refrigerant is sucked into and compressed by the compressor 21, and then is discharged from the compressor 21, in the refrigerant circuit 10. In the cooling operation, the low pressure in the refrigeration cycle corresponds to the suction pressure be detected by the suction pressure sensor 37*a*, and the high pressure in the refrigeration cycle corresponds to the discharge pressure detected by the discharge pressure sensor 37*c*.

The compressor 21 is subjected to capacity control according to the cooling load to be required for the usage unit 50. Specifically, the operating frequency of the compressor 21 is controlled such that the suction pressure takes a target value set in accordance with the cooling load to be required for the usage unit 50.

The gas refrigerant discharged from the compressor 21 flows into the heat source-side heat exchanger 23 through the gas-side end of the heat source-side heat exchanger 23, via the discharge-side refrigerant pipe 32, the four-way switching valve 22, and the first heat source-side gas refrigerant pipe 33.

When the gas refrigerant flows into the heat source-side heat exchanger 23 through the gas-side end of the heat source-side heat exchanger 23, the heat source-side heat exchanger 23 causes the gas refrigerant to exchange heat with the heat source-side air supplied by the heat source-side fan 36, thereby radiating heat, and then condenses the gas refrigerant to turn the gas refrigerant into the liquid refrigerant. The liquid refrigerant flows out of the heat source-side heat exchanger 23 through the liquid-side end of the heat source-side heat exchanger 23.

When the liquid refrigerant flows out of the heat source-side heat exchanger 23 through the liquid-side end of the heat source-side heat exchanger 23, then the liquid refrigerant flows into the receiver 24 through the inlet of the receiver 24 via a portion, extending from the heat source-side heat exchanger 23 to the receiver 24, of the heat source-side liquid refrigerant pipe 34. When the liquid refrigerant flows into the receiver 24, the receiver 24 temporarily stores therein the liquid refrigerant in a saturated state. Thereafter, the liquid refrigerant flows out of the receiver 24 through the outlet of the receiver 24.

When the liquid refrigerant flows out of the receiver 24 through the outlet of the receiver 24, then the liquid refrigerant flows into the subcooler 25 through the heat source-side liquid refrigerant pipe 34 side inlet of the subcooler 25 via a portion, extending from the receiver 24 to the subcooler 25, of the heat source-side liquid refrigerant pipe 34.

When the liquid refrigerant flows into the subcooler 25, the subcooler 25 causes the liquid refrigerant to exchange heat with the refrigerant flowing through the injection pipe 26, and further cools the liquid refrigerant, thereby bringing the liquid refrigerant into a subcooled state. The resultant liquid refrigerant flows out of the subcooler 25 through the heat source-side expansion valve 28 side outlet of the subcooler 25.

When the liquid refrigerant flows out of the subcooler 25 through the heat source-side expansion valve 28 side outlet of the subcooler 25, then the liquid refrigerant flows to the heat source-side expansion valve 28 via a portion, between the subcooler 25 and the heat source-side expansion valve 28, of the heat source-side liquid refrigerant pipe 34. At this time, the liquid refrigerant, which has flown out of the subcooler 25 through the heat source-side expansion valve 28 side outlet of the subcooler 25, is partly shunted to the injection pipe 26 from the portion, between the subcooler 25 and the heat source-side expansion valve 28, of the heat source-side liquid refrigerant pipe 34.

The refrigerant flowing through the injection pipe 26 is decompressed to have an intermediate pressure in the refrigeration cycle by the injection valve 27. The refrigerant decompressed by the injection valve 27 flows through the injection pipe 26, and then flows into the subcooler 25 through the injection pipe 26 side inlet of the subcooler 25. When the refrigerant flows into the subcooler 25 through the injection pipe 26 side inlet of the subcooler 25, the subcooler 25 causes the refrigerant to exchange heat with the refrigerant flowing through the heat source-side liquid refrigerant pipe 34, and then heats the refrigerant to turn the refrigerant into the gas refrigerant. The refrigerant heated by the subcooler 25 flows out of the subcooler 25 through the injection pipe 26 side outlet of the subcooler 25, and then returns to the compressor 21 in the intermediate state of the compression process.

The liquid refrigerant, which has flown to the heat source-side expansion valve 28 via the heat source-side liquid refrigerant pipe 34, flows into the usage unit 50 being operated, via the liquid-side shutoff valve 29 and the liquid-refrigerant connection pipe 6, without being decompressed by the heat source-side expansion valve 28 brought into the fully open state in the normal operating mode.

When the refrigerant flows into the usage unit 50, then the refrigerant flows into the usage-side expansion valve 54 via a part of the usage-side liquid refrigerant pipe 59. When the refrigerant flows into the usage-side expansion valve 54, then the refrigerant is decompressed to have the low pressure in the refrigeration cycle by the usage-side expansion valve 54. Thereafter, the refrigerant flows into the usage-side heat exchanger 52 through the liquid-side end of the usage-side heat exchanger 52 via the usage-side liquid refrigerant pipe 59. When the refrigerant flows into the usage-side heat exchanger 52 through the liquid-side end of the usage-side heat exchanger 52, the usage-side heat exchanger 52 causes the refrigerant to exchange heat with the usage-side air supplied by the usage-side fan 53, and evaporates the refrigerant to turn the refrigerant into the gas refrigerant. The resultant gas refrigerant flows out of the usage-side heat exchanger 52 through the gas-side end of the usage-side heat exchanger 52. When the gas refrigerant flows out of the usage-side heat exchanger 52 through the gas-side end of the usage-side heat exchanger 52, then the gas refrigerant flows to the gas-refrigerant connection pipe 7 via the usage-side gas refrigerant pipe 58.

The refrigerant, which has flown out of the usage unit 50, flows through the gas-refrigerant connection pipe 7, and then is sucked into the compressor 21 again, via the gas-side shutoff valve 30, the second heat source-side gas refrigerant pipe 35, the four-way switching valve 22, and the suction-side refrigerant pipe 31.

(4) Flow of Refrigerant and Flow of Processing in Defrosting Operating Mode

Next, a description will be given of the flow of the refrigerant and the flow of the processing in the refrigerant circuit 10 in the defrosting operating mode.

Figure 3:
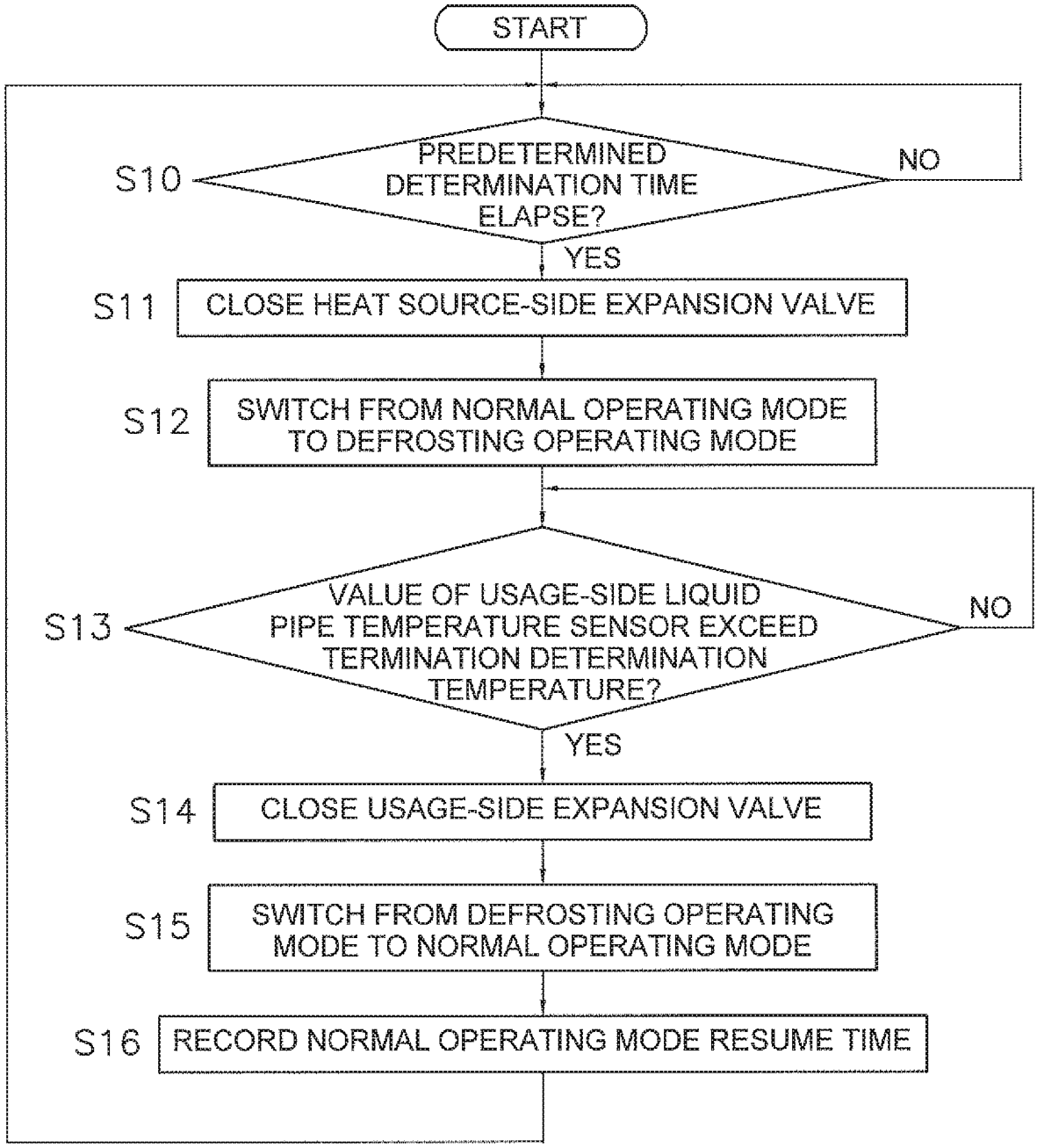
FIG. 3 is a flowchart of exemplary processing to be performed by the controller in a defrosting operating mode.

FIG. 3 is a flowchart of processing that involves switching the operating mode from the normal operating mode to the defrosting operating mode, executing the defrosting operating mode, and returning the operating mode from the defrosting operating mode to the normal operating mode.

The processing is started in the normal operating mode.

In step S10, the controller 70 determines whether the normal operating mode is continuously executed for the predetermined determination time. Specifically, the controller 70 determines whether the predetermined determination time is elapsed after timing (a recorded time) at which the normal operating mode has started after the termination of the last defrosting operating mode. The controller 70 makes a determination as to a lapse of the predetermined determination time, using the timer control unit 76. When the controller 70 determines that the predetermined determination time is elapsed, the processing proceeds to step S11. When the controller 70 determines that the predetermined determination time is not elapsed, then the controller 70 makes a determination in step S10 again.

In step S11, the controller 70 closes the heat source-side expansion valve 28 with the compressor 21 driven. The controller 70 thus suppresses the inflow of the liquid refrigerant into the compressor 21 in large amount in switching the operating mode from the normal operating mode to the defrosting operating mode (i.e., in switching the connection state of the four-way switching valve 22 from the defrosting connection state to the normal connection stat) in step S12 to be described later. The processing then proceeds to step S12.

In step S12, the controller 70 switches the operating mode from the normal operating mode to the defrosting operating mode, using the mode control unit 73.

The defrosting operating mode is executed with the connection state of the four-way switching valve 22 switched to the defrosting connection state. In the defrosting operating mode, the defrosting operation (the refrigeration cycle operation) is performed, causing the refrigerant in the refrigerant circuit 10 to mainly circulate through the compressor 21, the usage-side heat exchanger 52, the usage-side expansion valve 54, the heat source-side expansion valve 28, the receiver 24, and the heat source-side heat exchanger 23 in this order.

When the defrosting operation is started, the refrigerant is sucked into and compressed by the compressor 21, and then is discharged from the compressor 21 in the refrigerant circuit 10. The compressor 21 is operated at a predetermined maximum driving frequency.

The gas refrigerant discharged from the compressor 21 flows into the usage-side heat exchanger 52 through the gas-side end of the usage-side heat exchanger 52, via the discharge-side refrigerant pipe 32, the four-way switching valve 22, the second heat source-side gas refrigerant pipe 35, and the gas-refrigerant connection pipe 7.

When the gas refrigerant flows into the usage-side heat exchanger 52 through the gas-side end of the usage-side heat exchanger 52, then the gas refrigerant radiates heat by melting frost on an outer surface of the usage-side heat exchanger 52, so that the gas refrigerant is turned into the liquid refrigerant by condensation. Then, the resultant liquid refrigerant flows out of the usage-side heat exchanger 52 through the liquid-side end of the usage-side heat exchanger 52. The usage-side fan 53 is brought into the stopped state in the defrosting operating mode.

When the liquid refrigerant flows out of the usage-side heat exchanger 52 through the liquid-side end of the usage-side heat exchanger 52, then the liquid refrigerant passes, without being decompressed, through the usage-side expansion valve 54 whose valve opening degree is controlled such that the usage-side expansion valve 54 is in the fully open state. The liquid refrigerant then flows into the heat source unit 2 via the liquid-refrigerant connection pipe 6.

When the liquid refrigerant flows into the heat source unit 2, then the liquid refrigerant flows to the heat source-side expansion valve 28. In the defrosting operating mode, the heat source-side expansion valve 28 is controlled by the controller 70 such that the degree of superheating of the refrigerant at the suction side of the compressor 21 becomes a predetermined degree of superheating (e.g., 5 degrees). In the heat source-side expansion valve 28, therefore, the refrigerant is decompressed to have the low pressure in the refrigerant circuit 10.

When the refrigerant passes through the heat source-side expansion valve 28, then the refrigerant is not shunted to the injection pipe 26 since the injection valve 27 is brought into the fully closed state in the defrosting operating mode. The refrigerant then passes through the subcooler 25 where heat exchange is not particularly performed, and flows to the receiver 24. When the liquid refrigerant flows into the receiver 24, the receiver 24 temporarily stores therein the liquid refrigerant in the saturated state. Thereafter, the liquid refrigerant flows out of the receiver 24 through the outlet of the receiver 24.

When the liquid refrigerant flows out of the receiver 24 through the outlet of the receiver 24, then the liquid refrigerant flows into the heat source-side heat exchanger 23 through the liquid-side end of the heat source-side heat exchanger 23. When the refrigerant flows into the heat source-side heat exchanger 23 through the liquid-side end of the heat source-side heat exchanger 23, the heat source-side heat exchanger 23 causes the refrigerant to exchange heat with the heat source-side air supplied by the heat source-side fan 36 whose airflow volume is controlled to acquire a predetermined maximum number of rotations, thereby evaporating the refrigerant to turn the refrigerant into the gas refrigerant. The resultant gas refrigerant then flows out of the heat source-side heat exchanger 23 through the gas-side end of the heat source-side heat exchanger 23. When the gas refrigerant flows out of the heat source-side heat exchanger 23 through the gas-side end of the heat source-side heat exchanger 23, then the gas refrigerant is sucked into the compressor 21 again via the first heat source-side gas refrigerant pipe 33, the four-way switching valve 22, and the suction-side refrigerant pipe 31.

The processing in step S13 is performed under the execution of the defrosting operating mode described above.

In step S13, the controller 70 determines whether a temperature detected by the usage-side liquid pipe temperature sensor 85 exceeds a predetermined termination determination temperature. When the detected temperature exceeds the termination determination temperature, the processing proceeds to step S14. When the detected temperature does not exceed the termination determination temperature, the controller 70 makes a determination in step S13 again to continue the defrosting operating mode.

In step S14, the controller 70 closes the usage-side expansion valve 54 with the compressor 21 driven. The controller 70 thus suppresses the inflow of the liquid refrigerant into the compressor 21 in large amount in switching the operating mode from the defrosting operating mode to the normal operating mode (i.e., in switching the connection state of the four-way switching valve 22 from the normal connection state to the defrosting connection state) in step S15 to be described later. The processing then proceeds to step S15.

In step S15, the controller 70 switches the operating mode from the defrosting operating mode to the normal operating mode, using the mode control unit 73. The processing then proceeds to step S16.

In step S16, the controller 70 records a time at which the normal operating mode is resumed. The processing then returns to step S10 and is performed again.

(5) Flow of Processing by Controller 70 in Refrigerant Leak Control Mode

Figure 4:
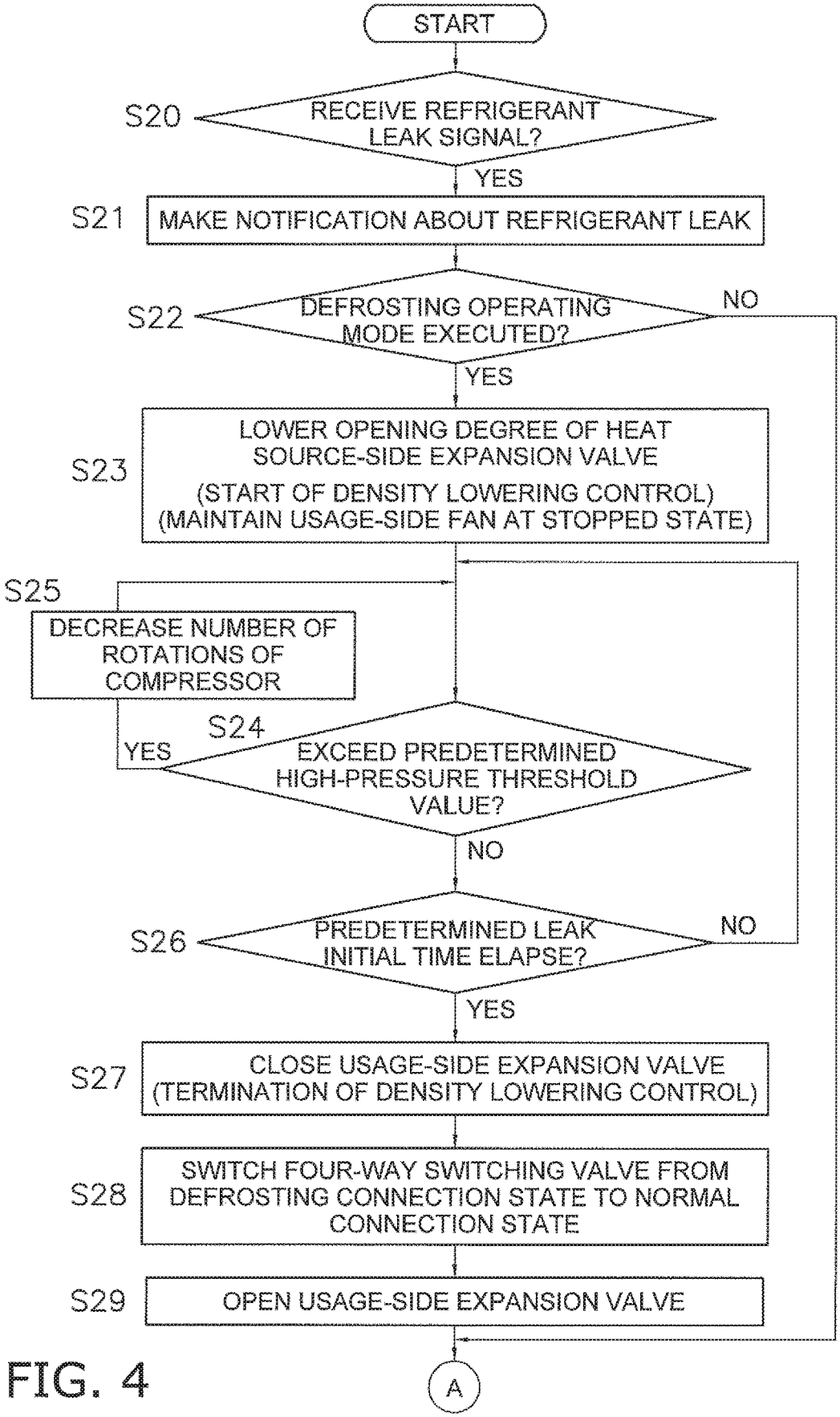
FIG. 4 is a flowchart (first half) of exemplary processing to be performed by the controller in a refrigerant leak control mode.
Figure 5:
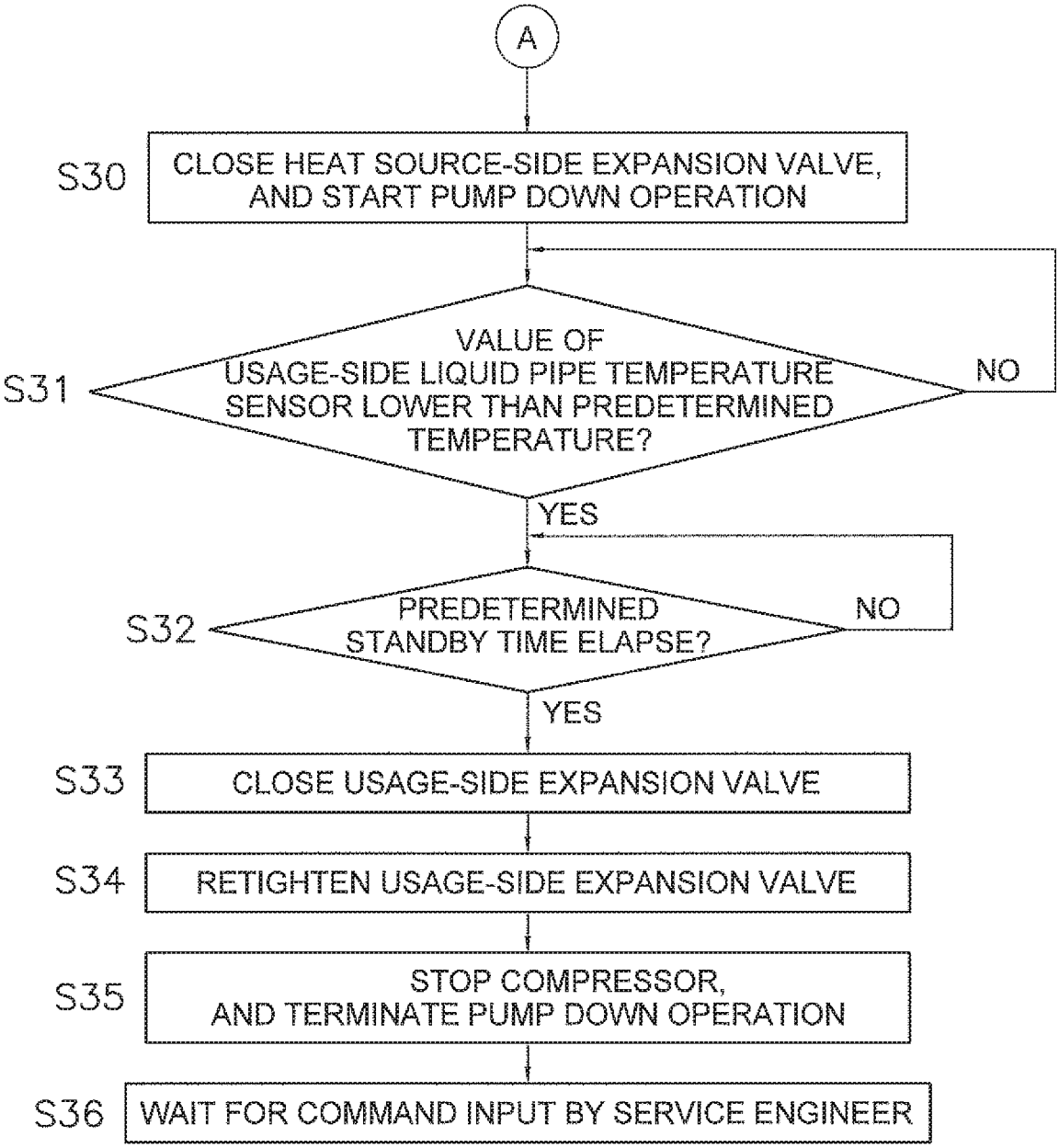
FIG. 5 is a flowchart (second half) of exemplary processing to be performed by the controller in the refrigerant leak control mode.

With reference to a flowchart of FIG. 4 and a flowchart of FIG. 5, next, a description will be given of exemplary processing to be performed by the controller 70 in a case where a refrigerant leak occurs in the normal operating mode or the defrosting operating mode.

In step S20, the controller 70 determines whether to receive a refrigerant leak signal from the refrigerant leak sensor 81, that is, determines whether to satisfy a predetermined leak condition. When the controller 70 receives the refrigerant leak signal, the processing proceeds to step S21. When the controller 70 does not receive the refrigerant leak signal, the controller 70 continues the operating mode currently executed, and makes a determination in step S20 again.

In step S21, the controller 70 causes the remote controller 50*a* to make a notification about occurrence of a refrigerant leak. The remote controller 50*a* may make a notification in the form of display on a screen and in the form of output by sound. The processing then proceeds to step S22.

In step S22, the controller 70 determines whether the operating mode currently executed is the defrosting operating mode. When the defrosting operating mode is currently executed, the processing proceeds to step S23. When the normal operating mode is currently executed, the processing proceeds to step S30 (see FIG. 5).

In step S23, the controller 70 switches the operating mode from the defrosting operating, mode to the refrigerant leak control mode, and starts the density lowering control. Specifically, the controller 70 lowers the valve opening degree of the heat source-side expansion valve 28 while maintaining the number of rotations of the compressor 21 at the number of rotations in the preceding defrosting operating mode. In the defrosting operating mode, the valve opening degree of the heat source-side expansion valve 28 is controlled such that the suction refrigerant into the compressor 21 has the predetermined degree of superheating. In contrast to this, in the density lowering control, the controller 70 further lowers the valve opening degree below the valve opening degree in the defrosting operating mode. In the density lowering control, specifically, the controller 70 lowers the valve opening degree of the heat source-side expansion valve 28 such that the temperature of the refrigerant discharged from the compressor 21 takes a discharge temperature target value higher by a predetermined temperature than the discharge refrigerant temperature in the defrosting operating mode immediately before the start of the refrigerant leak control mode. The controller 70 controls the valve opening degree of the heat source-side expansion valve 28 to maintain a state in which the valve opening degree is below the valve opening degree of the heat source-side expansion valve 28 in the defrosting operating mode immediately before the start of the refrigerant leak control mode.

In the density lowering control, the controller 70 maintains the usage-side fan 53 at the stopped state continuously from the defrosting operating mode. The processing then proceeds to step S24.

In step S24, the controller 70 determines whether the high-pressure refrigerant in the refrigerant circuit 10 (i.e., the refrigerant pressure detected by the discharge pressure sensor 37*c*) exceeds a predetermined high-pressure threshold value. When the controller 70 determines that the high-pressure refrigerant exceeds the predetermined high-pressure threshold value, the processing proceeds to step S25. When the controller 70 determines that the high-pressure refrigerant does not exceed the predetermined high-pressure threshold value, the processing proceeds to step S26.

In step S25, the controller 70 decreases the number of rotations of the compressor 21. The controller 70 may decrease the number of rotations of the compressor 21 by, but not limited thereto, a predetermined number of rotations. The processing then returns to step S24.

In step S26, the controller 70 determines whether a predetermined leak initial time set in advance elapses from the start of the density lowering control in step S23, using the timer control unit 76. When the predetermined leak initial time elapses, the processing proceeds to step S27. When the predetermined leak initial time does not elapse, the processing returns to step S24.

In step S27, the controller 70 terminates the density lowering control, and closes the usage-side expansion valve 54 of the usage unit 50 with the compressor 21 driven. The controller 70 thus suppresses the inflow of the liquid refrigerant into the compressor 21 in large amount in switching the connection state of the four-way switching valve 22 from the defrosting connection state to the normal connection stat in step S28 to be described later. The processing then proceeds to step S28. The control for the valve opening degree of the heat source-side expansion valve 28 after the termination of the density lowering control is not limited. In this embodiment, for example, the controller 70 maintains the valve opening degree of the heat source-side expansion valve 28 at the valve opening degree at the termination of the density lowering control.

In step S28, the controller 70 switches the connection state of the four-way switching valve 22 from the defrosting connection state to the normal connection state with the compressor 21 driven. The processing then proceeds to step S29.

In step S29, the controller 70 opens the usage-side expansion valve 54 with the compressor 21 driven. For example, the controller 70 may control the valve opening degree of the usage-side expansion valve 54 such that the degree of superheating of the refrigerant to be sucked into the compressor 21 becomes the predetermined degree of superheating. However, the control by the controller 70 is not limited thereto. The processing then proceeds to step S30 (see FIG. 5).

In step S30, the controller 70 closes the heat source-side expansion valve 28 with the compressor 21 driven. The controller 70 thus starts the pump down operation for collecting the refrigerant in the refrigerant circuit 10 onto the upstream side of the heat source-side expansion valve 28 and into the heat source-side heat exchanger 23. In the pump down operation, the usage-side fan 53 is brought into a driven state.

In step S31, the controller 70 determines whether a temperature detected by the usage-side liquid pipe temperature sensor 85 is lower than a predetermined temperature. The predetermined temperature is not limited and may be set in advance as a temperature to be used for determining that the remaining amount of the refrigerant in the usage-side heat exchanger 52 functioning as the evaporator in the refrigerant circuit 10 is small. This determination enables grasp of a situation in which most of the refrigerant in the refrigerant circuit 10 is collected onto the upstream side of the heat source-side expansion valve 28 and into the heat source-side heat exchanger 23, so that the pump down operation nears the terminatable stage. When the controller 70 determines that the temperature is lower than the predetermined temperature, the processing proceeds to step S32. When the controller 70 determines that the temperature is equal to or higher than the predetermined temperature, the controller 70 makes a determination in step S31 again.

In step S32, the controller 70 determines whether a predetermined standby time elapses from the closure of the heat source-side expansion valve 28 in step S30, using the timer control unit 76. When the predetermined standby time elapses, the processing proceeds to step S33. When the predetermined standby time does not elapse, the controller 70 makes a determination in step S32 again. By a lapse of the predetermined standby time, the refrigerant downstream of the closed heat source-side expansion valve 28 and upstream of the usage-side expansion valve 54 is also collected onto the upstream side of the heat source-side expansion valve 28 and into the heat source-side heat exchanger 23.

In step S33, the controller 70 closes the usage-side expansion valve 54. Closing the usage-side expansion valve 54 enables a reduction in amount of the refrigerant remaining on the upstream side of the usage-side expansion valve 54. Therefore the amount of the refrigerant that leaks from a slight gap of the closed usage-side expansion valve 54 and flows toward a leak spot is reduced even after the operation stop. The processing then proceeds to step S34.

In step S34, the controller 70 performs retightening of the usage-side expansion valve 54. Since the controller 70 closes the usage-side expansion valve 54 in step S33, the usage-side expansion valve 54 should be in the fully closed state. However, the valve may be sometimes in a slightly opened state as unintended since the valve body may not be completely returned to an intended position. For this reason, the controller 70 performs retightening of the usage-side expansion valve 54 by further sending a pulse signal for closing the valve the usage-side expansion valve 54 to further lower the opening degree or completely close the usage-side expansion valve 54.

In step S35, the controller 70 stops the compressor 21 to terminate the pump down operation. The processing then proceeds to step S36.

In step S36, the controller 70 is in a standby state until, for example, a service engineer who receives the notification about the refrigerant leak in step S21 rushes to the site. When the service engineer inputs a new command through the remote controller 50*a* on the site, the controller 70 performs processing on the basis of this command.

(6) Features of Refrigeration Apparatus 100

(6-1)

In this embodiment, the refrigeration apparatus 100 performs the density lowering control to lower the density of the refrigerant supplied to the usage-side heat exchanger 52 when a refrigerant leak occurs at the usage unit 50 in the defrosting operating mode.

Specifically, the refrigeration apparatus 100 lowers the valve opening degree of the heat source-side expansion valve 28 such that the temperature of the refrigerant discharged from the compressor 21 takes the discharge temperature target value higher by the predetermined temperature than the discharge refrigerant temperature immediately before the start of the refrigerant leak control mode. The refrigeration apparatus 100 lowers the valve opening degree of the heat source-side expansion valve 28 as described above, thereby reducing the pressure of the low-pressure refrigerant on the suction side of the compressor 21 and increasing the degree of superheating of the refrigerant to be sucked into the compressor 21. In the compressor 21 that sucks the refrigerant gas whose degree of superheating increases, an isentropic change of the refrigerant causes an increase in temperature of the discharge refrigerant and also causes an increase in degree of superheating of the discharge refrigerant.

As described above, the refrigeration apparatus 100 performs the density lowering control to lower the valve opening degree of the heat source-side expansion valve 28, thereby lowering the density of the refrigerant supplied from the compressor 21 toward the usage-side heat exchanger 52 where a refrigerant leak occurs.

In addition, if a refrigerant leak occurs, the refrigeration apparatus 100 maintains the rotation of the usage-side fan 53 at the stopped state continuously from the defrosting operation. The refrigeration apparatus 100 therefore suppresses an increase in refrigerant density due to condensation of the refrigerant in the usage-side heat exchanger 52, and also suppresses a leak of the high-density refrigerant.

In addition, the refrigeration apparatus 100 decreases the number of rotations of the compressor 21 when the high pressure in the refrigerant circuit 10 exceeds the predetermined high-pressure threshold value after the start of the density lowering control with the heat source-side expansion valve 28 closed. The refrigeration apparatus 100 therefore avoids a state in which the refrigerant discharged from the compressor 21 forcibly flows into the leak spot at the usage-side heat exchanger 52, and suppresses an increase in leakage of the refrigerant.

As described above, the refrigeration apparatus 100 suppresses a leak of a high-density refrigerant from a refrigerant leak spot, and reduces the amount of the leakage of the refrigerant. For example, in a case where the refrigeration apparatus 100 employs a combustible refrigerant, the refrigeration apparatus 100 suppresses the leakage of the combustible refrigerant leak, thereby suppressing a state in which the concentration of the leaking refrigerant reaches a combustible range.

(6-2)

In this embodiment, when a refrigerant leak occurs at the usage unit 50 in the defrosting operating mode, the refrigeration apparatus 100 performs the density lowering control. The refrigeration apparatus 100 then terminates the defrosting operating mode, and switches the connection state of the four-way switching valve 22 from the defrosting connection state to the normal connection state.

The refrigeration apparatus 100 thus disconnects the discharge side of the compressor 21 from the usage-side heat exchanger 52 corresponding to the leak spot and the vicinity of the usage-side heat exchanger 52, and connects the usage-side heat exchanger 52 corresponding to the leak spot and the vicinity of the usage-side heat exchanger 52 to the suction side of the compressor 21. The refrigeration apparatus 100 consequently reduces the amount of the leakage of the refrigerant from the leak spot.

(6-3)

In this embodiment, when a refrigerant leak occurs, the refrigeration apparatus 100 starts the density lowering control more promptly without being on standby until a condition for terminating the defrosting operating mode, that is, a condition that a temperature detected by the usage-side liquid pipe temperature sensor 85 exceeds the termination determination temperature is satisfied, even in the defrosting operating mode. The refrigeration apparatus 100 then switches the connection state of the four-way switching valve 22 from the defrosting connection state to the normal connection state. The refrigeration apparatus 100 consequently reduces a time during which a refrigerant leaks in large amount.

(6-4)

In this embodiment, when a refrigerant leak occurs, the refrigeration apparatus 100 performs the density lowering control, and also performs the pump down operation of collecting the refrigerant in the refrigerant circuit 10 onto the upstream side of the heat source-side expansion valve 28 and into the heat source-side heat exchanger 23. The refrigeration apparatus 100 then stops the compressor 21. The refrigeration apparatus 100 consequently decreases a possibility that the refrigerant reaches the refrigerant leak spot after the stop of the compressor 21.

In the pump down operation, the refrigeration apparatus 100 operates the compressor 21 for at least the predetermined standby time with the heat source-side expansion valve 28 closed, and then closes the usage-side expansion valve 54. The refrigeration apparatus 100 consequently collects the refrigerant downstream of the closed heat source-side expansion valve 28 and upstream of the usage-side expansion valve 54, onto the upstream side of the heat source-side expansion valve 28 and into the heat source-side heat exchanger 23. Accordingly, since the remaining amount of the refrigerant downstream of the heat source-side expansion valve 28 and upstream of the usage-side expansion valve 54 is small after the stop of the compressor 21, the refrigeration apparatus 100 reduces the amount of the leakage of the refrigerant even if the refrigerant passes through the usage-side expansion valve 54 toward the leak spot.

(6-5)

In this embodiment, when a refrigerant leak occurs, the refrigeration apparatus 100 performs retightening of the usage-side expansion valve 54, the retightening being not performed in switching the operating mode from the defrosting operating mode to the normal operating mode. The refrigeration apparatus 100 consequently reduces, with reliability, the amount of the refrigerant passing through the usage-side expansion valve 54 toward the leak spot.

(7) Modifications

The foregoing embodiment may be appropriately modified as described in the following modifications. It should be noted that these modifications are applicable in conjunction with other modifications insofar as there are no inconsistencies.

(7-1) Modification A

According to the foregoing embodiment, the usage-side fan 53 is brought into the stopped state in the defrosting operation. Moreover, even when the density lowering control is performed with the predetermined leak condition satisfied, the usage-side fan 53 is continuously maintained at the stopped state.

Alternatively, the usage-side fan 53 may not be brought into the stopped state, but may be driven at low speed in the defrosting operation. When the density lowering control is performed with the predetermined leak condition satisfied, the airflow volume of the usage-side fan 53 may be controlled to be smaller than the airflow volume in the defrosting operation.

This configuration also suppresses condensation of the refrigerant in the usage-side heat exchanger 52, and suppresses an increase in density of the refrigerant near the leak spot.

(7-2) Modification B

According to the foregoing embodiment, the controller 70 performs the density lowering control due to occurrence of a refrigerant leak, performs the pump down operation with the connection state of the four-way switching valve 22 switched from the defrosting connection state to the normal connection state, and then stops the compressor 21.

Alternatively, the controller 70 may perform the density lowering control due to occurrence of a refrigerant leak, and then stop the compressor 21 without switching the connection state of the four-way switching valve 22.

(7-3) Modification C

According to the foregoing embodiment, the usage unit 50 of the refrigeration apparatus 100 includes the usage-side expansion valve 54 being an electric expansion valve whose opening degree is controllable.

Figure 6:
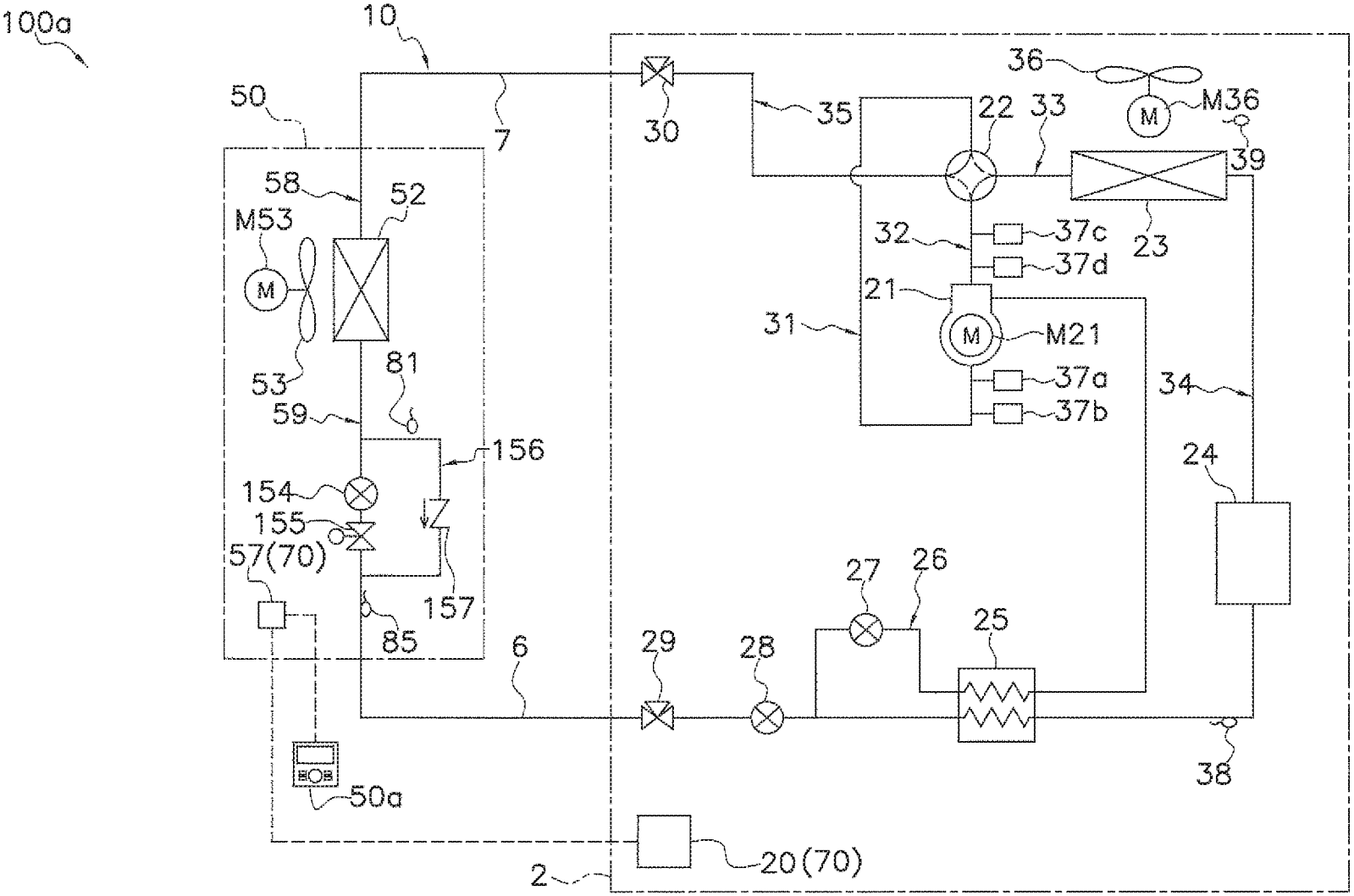
FIG. 6 is a general configuration diagram of a refrigeration apparatus including a refrigerant circuit according to Modification C.

As illustrated in FIG. 6, alternatively, a refrigeration apparatus 100*a* may include: an on-off valve 155 and a thermostatic (mechanical) usage-side expansion valve 154 provided in place of the usage-side expansion valve 54 being an electric expansion valve; and a check circuit 156 and a check valve 157 connecting an upstream side of each of the on-off valve 155 and the usage-side expansion valve 154 to a downstream side of each of the on-off valve 155 and the usage-side expansion valve 154.

The on-off valve 155 is an electromagnetic valve that is electrically connected to a controller 70, and the controller 70 opens and closes the on-off valve 155. The thermostatic (mechanical) usage-side expansion valve 154 is disposed in the side of the usage-side heat exchanger 52 with respect to the on-off valve 155. The opening degree of the thermostatic (mechanical) usage-side expansion valve 154 is not controlled by the controller 70, but is automatically changed in accordance with a temperature grasped by a feeler bulb. The check circuit 156 connects a portion between the usage-side expansion valve 154 and the usage-side heat exchanger 52 to a portion opposite to the usage-side heat exchanger 52 with respect to the on-off valve 155, on a usage-side liquid refrigerant pipe 59. The check circuit 156 branches off the usage-side liquid refrigerant pipe 59 to allow a flow of a refrigerant. The check circuit 156 is provided with the check valve 157 that allows a flow of the refrigerant passing through the usage-side heat exchanger 52 toward a liquid-refrigerant connection pipe 6, and interrupts a flow of the refrigerant flowing from the liquid-refrigerant connection pipe 6 toward the usage-side heat exchanger 52.

This configuration also produces similar advantageous effects to those of the foregoing embodiment. In a normal operating mode, the refrigerant flows through the liquid-refrigerant connection pipe 6 and then passes through the on-off valve 155 that is opened. The refrigerant is decompressed in the thermostatic (mechanical) usage-side expansion valve 154, and then is supplied to the usage-side heat exchanger 52 functioning as an evaporator. In a defrosting operating mode, the refrigerant passes through the usage-side heat exchanger 52 functioning as a radiator, and then flows toward the liquid-refrigerant connection pipe 6 via the check circuit 156 and the check valve 157. When a refrigerant leak occurs, the controller 70 closes the on-off valve 155 instead of the usage-side expansion valve 54 in the foregoing embodiment.

(7-4) Modification D

According to the foregoing embodiment, in starting the density lowering control in the refrigerant leak control mode, the controller 70 lowers the valve opening degree of the heat source-side expansion valve 28 while maintaining the number of rotations of the compressor 21 in the preceding defrosting operating mode, thereby lowering the density of the refrigerant supplied to the usage unit 50.

However, the method of lowering the density of the refrigerant supplied to the usage unit 50 is not limited to the method described in the foregoing embodiment. For example, it is only required that the density of the refrigerant supplied from the compressor 21 toward the usage unit 50 in the preceding defrosting operating mode be lowered by the density lowering control. Therefore the controller 70 may control the number of rotations of the compressor 21 and the valve opening degree of the heat source-side expansion valve 28 in combination so as to lower the refrigerant density. For example, the storage unit 71 of the controller 70 previously may store therein an information table showing the relationship between the preset number of rotations of the compressor 21 and the corresponding valve opening degree of the heat source-side expansion valve 28. Then, the controller 70 may perform the density lowering control to control the number of rotations of the compressor 21 and the valve opening degree of the heat source-side expansion valve 28, on the basis of the information table.

(7-5) Modification E

According to the foregoing embodiment, the refrigeration apparatus 100 is of a pair type in which the heat source unit 2 and the usage unit 50 are connected in one to one correspondence.

However, the number of usage units and the number of heat source units are not limited to one. For example, the refrigeration apparatus 100 may include a plurality of usage units and a plurality of heat source units. Alternatively, the refrigeration apparatus 100 may include one heat source unit and a plurality of usage units connected to the heat source unit in parallel.

(7-6) Modification F

According to the foregoing embodiment, the refrigerant leak sensor 81 is disposed to detect a refrigerant leak at the usage unit 50. If a refrigerant leak at the usage unit 50 is detectable without the refrigerant leak sensor 81, however, the refrigeration apparatus 100 does not necessarily include the refrigerant leak sensor 81.

For example, the usage unit 50 may include a sensor such as a refrigerant pressure sensor or a refrigerant temperature sensor. If a refrigerant leak at the usage unit 50 is detectable on the basis of a change of a value detected by such a sensor, the refrigerant leak sensor 81 may be omitted.

(7-7) Modification G

According to the foregoing embodiment, the refrigeration apparatus 100 is configured to cool, for example, the interior of a cold storage warehouse or the interior of a showcase in a store.

However, the use of the refrigeration apparatus 100 is not limited thereto. For example, the refrigeration apparatus 100 may be configured to cool the interior of a container for transportation. Alternatively, the refrigeration apparatus 100 may be an air conditioning system (an air conditioner) that achieves air conditioning by cooling the interior of a building or the like.

(7-8) Modification 1-1

According to the foregoing embodiment, R32 is employed as a refrigerant that circulates through the refrigerant circuit 10.

However, the refrigerant for use in the refrigerant circuit 10 is not limited there to. For example, HFO1234yf, HFO1234ze, and a mixture thereof may be employed in place of R32 for the refrigerant circuit 10. Alternatively, a hydrofluorocarbon (HFC) refrigerant such as R407C or R410A may be employed for the refrigerant circuit 10. Still alternatively, a combustible refrigerant such as propane or a toxic refrigerant such as ammonia may be employed for the refrigerant circuit 10.

INDUSTRIAL APPLICABILITY

The present invention is applicable to a refrigeration apparatus.

REFERENCE SIGNS LIST

2: heat source unit
10: refrigerant circuit
20: heat source unit control unit
21: compressor
23: heat source-side heat exchanger
24: receiver
25: subcooler
26: injection pipe
27: injection valve
28: heat source-side expansion valve
37*a*: suction pressure sensor
37*b*: suction temperature sensor
37*c*: discharge pressure sensor
37*d*: discharge temperature sensor
50: usage unit
52: usage-side heat exchanger
54: usage-side expansion valve
55: on-off valve
57: usage unit control unit
58: usage-side gas refrigerant pipe
59: usage-side liquid refrigerant pipe
70: controller (control unit)
81: first refrigerant leak sensor
85: usage-side liquid pipe temperature sensor (usage-side temperature sensor)
100, 100*a*: refrigeration apparatus
154: usage-side expansion valve
155: on-off valve
156: check circuit
157: check valve

CITATION LIST

Patent Literature

Patent Literature 1: JP 2015-94573 A

The invention claimed is:

1. A refrigeration apparatus comprising:
a refrigerant circuit including
a compressor, a heat source-side heat exchanger, and a heat source-side expansion valve of a heat source unit,
a usage-side heat exchanger of a usage unit, and
a switching valve configured to switch between a normal connection state in which the heat source-side heat exchanger functions as a radiator for the refrigerant and the usage-side heat exchanger functions as an evaporator for the refrigerant and a defrosting connection state in which the heat source-side heat exchanger functions as an evaporator for the refrigerant and the usage-side heat exchanger functions as a radiator for the refrigerant; and
a controller configured to switch the connection state of the switching valve to the defrosting connection state and to perform a defrosting operation when a predetermined defrosting condition is satisfied in the normal connection state of the switching valve,
wherein
the controller performs density lowering control to lower a refrigerant density in the usage-side heat exchanger while maintaining the switching valve at the defrosting connection state when a refrigerant leak situation in the usage unit satisfies a predetermined leak condition in the defrosting operation.

2. The refrigeration apparatus according to claim 1, wherein
when the refrigerant leak situation in the usage unit satisfies the predetermined leak condition in the defrosting operation, the controller performs the density lowering control by raising a temperature of the refrigerant discharged from the compressor while maintaining the switching valve at the defrosting connection state.

3. The refrigeration apparatus according to claim 2, wherein
when the refrigerant leak situation in the usage unit satisfies the predetermined leak condition in the defrosting operation, the controller raises the temperature of the refrigerant discharged from the compressor, by lowering a valve opening degree of the heat source-side expansion valve below a valve opening degree immediately before the refrigerant leak situation satisfies the predetermined leak condition, while maintaining the switching valve at the defrosting connection state.

4. The refrigeration apparatus according to claim 1, further comprising:

a usage-side fan of the usage unit, the usage-side fan being configured to provide an air flow for the usage-side heat exchanger, wherein when the refrigerant leak situation in the usage unit satisfies the predetermined leak condition in the defrosting operation, the controller maintains or decreases an airflow volume of the usage-side fan at or below an airflow volume immediately before the refrigerant leak situation satisfies the predetermined leak condition, while maintaining the switching valve at the defrosting connection state.

5. The refrigeration apparatus according to claim 1, wherein when a predetermined termination condition for terminating the density lowering control is satisfied, the controller switches the connection state of the switching valve to the normal connection state, and then stops the compressor.

6. The refrigeration apparatus according to claim 1, further comprising:

a usage-side temperature sensor configured to detect a temperature of the refrigerant flowing through the usage-side heat exchanger, wherein the controller switches the connection state of the switching valve to the normal connection state after the termination of the density lowering control, and then stops the compressor, and when the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

7. The refrigeration apparatus according to claim 6, further comprising:

a usage-side expansion valve of the usage unit, the usage-side expansion valve being disposed in a liquid side of the usage-side heat exchanger, wherein when the refrigerant leak situation satisfies the predetermined leak condition in the defrosting operation, the controller performs retightening of the usage-side expansion valve, and when the refrigerant leak situation does not satisfy the predetermined leak condition in the defrosting operation, the controller does not perform retightening of the usage-side expansion valve.

8. The refrigeration apparatus according to claim 2, further comprising:

a usage-side fan of the usage unit, the usage-side fan being configured to provide an air flow for the usage-side heat exchanger, wherein when the refrigerant leak situation in the usage unit satisfies the predetermined leak condition in the defrosting operation, the controller maintains or decreases an airflow volume of the usage-side fan at or below an airflow volume immediately before the refrigerant leak situation satisfies the predetermined leak condition, while maintaining the switching valve at the defrosting connection state.

9. The refrigeration apparatus according to claim 3, further comprising:

a usage-side fan of the usage unit, the usage-side fan being configured to provide an air flow for the usage-side heat exchanger, wherein when the refrigerant leak situation in the usage unit satisfies the predetermined leak condition in the defrosting operation, the controller maintains or decreases an airflow volume of the usage-side fan at or below an airflow volume immediately before the refrigerant leak situation satisfies the predetermined leak condition, while maintaining the switching valve at the defrosting connection state.

10. The refrigeration apparatus according to claim 2, wherein when a predetermined termination condition for terminating the density lowering control is satisfied, the controller switches the connection state of the switching valve to the normal connection state, and then stops the compressor.

11. The refrigeration apparatus according to claim 3, wherein when a predetermined termination condition for terminating the density lowering control is satisfied, the controller switches the connection state of the switching valve to the normal connection state, and then stops the compressor.

12. The refrigeration apparatus according to claim 4, wherein when a predetermined termination condition for terminating the density lowering control is satisfied, the controller switches the connection state of the switching valve to the normal connection state, and then stops the compressor.

13. The refrigeration apparatus according to claim 2, further comprising:

a usage-side temperature sensor configured to detect a temperature of the refrigerant flowing through the usage-side heat exchanger, wherein the controller switches the connection state of the switching valve to the normal connection state after the termination of the density lowering control, and then stops the compressor, and when the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

14. The refrigeration apparatus according to claim 3, further comprising:

a usage-side temperature sensor configured to detect a temperature of the refrigerant flowing through the usage-side heat exchanger, wherein the controller switches the connection state of the switching valve to the normal connection state after the termination of the density lowering control, and then stops the compressor, and when the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

15. The refrigeration apparatus according to claim 4, further comprising:

a usage-side temperature sensor configured to detect a temperature of the refrigerant flowing through the usage-side heat exchanger, wherein the controller switches the connection state of the switching valve to the normal connection state after the termination of the density lowering control, and then stops the compressor, and when the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

16. The refrigeration apparatus according to claim 5, further comprising:

a usage-side temperature sensor configured to detect a temperature of the refrigerant flowing through the usage-side heat exchanger, wherein the controller switches the connection state of the switching valve to the normal connection state after the termination of the density lowering control, and then stops the compressor, and when the refrigerant leak situation does not satisfy the predetermined leak condition in the defrosting operation, the controller terminates the defrosting operation when the temperature detected by the usage-side temperature sensor satisfies a predetermined temperature condition, and then switches the connection state of the switching valve to the normal connection state.

* * * * *